US005411248A

United States Patent [19]

Yamaguchi

[11] Patent Number: 5,411,248

[45] Date of Patent: May 2, 1995

[54] PAPER FEEDING DEVICE

[75] Inventor: Takeshi Yamaguchi, Aichi, Japan

[73] Assignee: Minolta Camera Kabushiki Kaisha, Osaka, Japan

[21] Appl. No.: 152,196

[22] Filed: Nov. 12, 1993

[30] Foreign Application Priority Data

Nov. 27, 1992 [JP] Japan ..... 4-318446

[51] Int. Cl.[6] ..... B65H 1/00

[52] U.S. Cl. ..... 271/171; 271/145

[58] Field of Search ..... 271/171, 234, 240, 249, 271/253, 144, 145

[56] References Cited

U.S. PATENT DOCUMENTS 4,752,809 6/1988 Ito ..... 355/14 R
4,780,740 10/1988 Fukae ..... 355/3 SH

FOREIGN PATENT DOCUMENTS 0133151 7/1984 Japan ..... 271/240
0190145 10/1984 Japan ..... 271/234
4075924 3/1992 Japan ..... 271/171

OTHER PUBLICATIONS

Lee et al., Low Cost Paper Aligner, May 1980, IBM Technical Disclosure Bulletin vol. 22, No. 12, p. 5228.

*Primary Examiner*—H. Grant Skaggs
*Assistant Examiner*—Carol L. Druzbick
*Attorney, Agent, or Firm*—Willian Brinks Hofer Gilson & Lione

[57] ABSTRACT

A paper feeding device having a supporting member for supporting recording paper thereon, and at least one width regulating member which is provided on the supporting member and freely movable in a direction perpendicular to a paper transporting direction. A slide portion provided on the width regulating member is adapted to slide along a guide surface formed on the supporting member. A width regulating surface on the width regulating member intended to contact with the recording paper is so disposed as to deviated in the transporting direction from the slide portion. When a recording paper in process of conveyance happens to swerve and pressingly contact with the width regulating surface, the width regulating member is made to generate moment and is consequently prevented from sliding due to the swerve of the recording paper.

5 Claims, 4 Drawing Sheets

PAPER FEEDING DEVICE

BACKGROUND OF THE INVENTION

1. Field of the Invention

This invention relates to a paper feeding device to be used in an image producing apparatus such as a laser beam printer for the purpose of feeding to a image producing portion one after another a multiplicity of recording papers stored in a stack therein.

2. Description of the Prior Art

The image producing apparatus such as a laser beam printer is provided with a paper feeding portion which serves the purpose of storing recording papers in a stack therein and, at the same time, feeding these recording papers one by one to an image producing portion. This paper feeding portion is provided with a width regulating member which serves the purpose of enabling the paper feeding portion to accommodate therein recording papers available in a plurality of different sizes and, at the same time, regulating the position of the stack of recording papers in the direction of width thereof. This width regulating member is so disposed in the paper feeding portion as to slide freely therein in the direction of width of paper. When a resist roller is set in place in front of the image forming portion on the downstream side of the paper feeding portion, it prevents a recording paper in process of travel from putting the leading edge thereof out of alignment or advancing in an oblique direction and consequently allows a given image to be formed correctly in a prescribed position. When this resist roller is excluded for the purpose of accomplishing miniaturization of the printer, therefore, the paper feeding portion must be adapted so that a recording paper in process of departure from the paper feeding portion will be prevented from advancing obliquely.

For the sake of accomplishing the miniaturization of the printer and, at the same time, ensuring formation of an image correctly at the prescribed position on the recording paper, the function of a paper regulating member or a width regulating member which is intended to regulate the position of a recording paper in the direction of width thereof counts very much. When the recording paper in process of departure from the paper feeding part is suffered to swerve, for example, the possibility arises that the recording paper will push the width regulating member out of position and eventually exert an adverse effect on the elimination of skew. As a measure to prevent the width regulating member from deviation, an idea of adapting the width regulating part to generate increased resistance to slide may be conceived. Such an addition to the resistance to slide, however, entails the problem of sacrificing the convenience with which the paper feeding portion is handled for setting recording papers in place therein. Further, the deviation of the width regulating member due to the swerve of a recording paper may be precluded by employing means which imparts clicks at fixed intervals to the width regulating member to repress the possible occurrence of an empty space due to the dimensional inconsistency of recording papers. This approach, however, boosts the cost of manufacture of the apparatus and renders infeasible economic production of a small image producing apparatus.

SUMMARY OF THE INVENTION

This invention has been produced by refining the prior art by the elimination of the various drawbacks thereof described above. It has an object of providing an inexpensive paper feeding device which allows recording papers to be set in place with enhanced efficiency and enables a given image to be formed correctly in a prescribed position on each of the recording papers.

This invention accomplishes the object described above by providing a paper feeding device comprising a supporting member for supporting recording papers and a width regulating member for regulating the recording papers set in place on the supporting member in the direction of width thereof, which paper feeding device is characterized by forming on the supporting member a guide surface in the direction perpendicular to the transporting direction of recording papers, providing the width regulating member with a slide member adapted to slide along the guide surface, and disposing at a position deviating from the slide member in the transporting direction of recording papers a width regulating surface adapted to collide against the lateral edges of the recording papers.

According to this invention, since the width regulating surface is formed at a position deviating in the transporting direction of a recording paper from the slide portion which slides along the guide surface formed on the supporting member, the width regulating member is made to generate moment and prevented from sliding even when recording papers mounted on the supporting member in process of departure therefrom swerve and exert pressure on the width regulating surface of the width regulating member. If a small braking force is intentionally applied to the width regulating member, the paper feeding device will no longer produce any deviating motion. As a result, the recording papers paid out of the paper feeding device will neither deviate nor advance in an oblique direction and an image is formed correctly at a prescribed position on each of the recording papers.

DETAILED DESCRIPTION OF THE PREFERRED EMBODIMENT

Now, this invention will be described below with reference to a example illustrated in the accompanying drawings.

Figure 1:
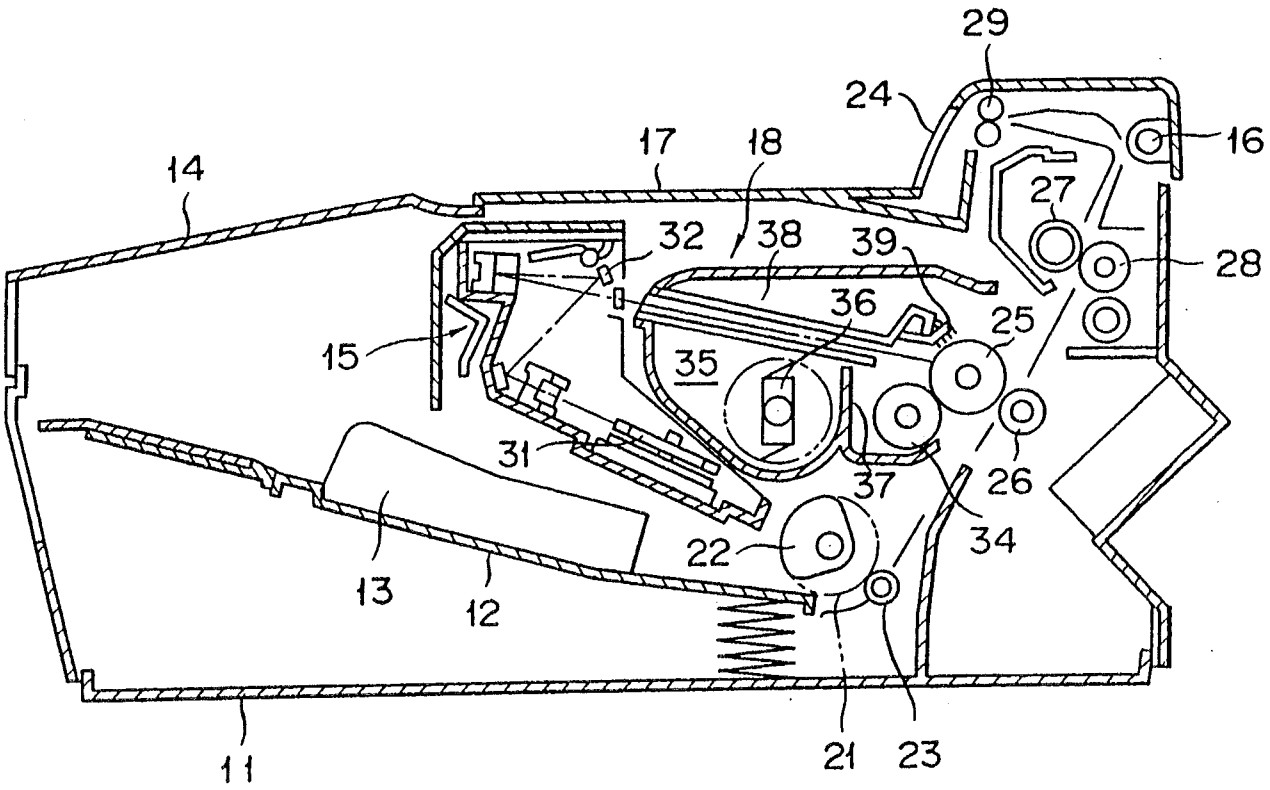
FIG. 1 is a schematic cross section illustrating the internal construction of a laser beam printer incorporating therein a paper feeding device of this invention.

FIG. 1 schematically illustrates in a cross section the internal construction of a laser beam printer which incorporates a paper feeding device according to this invention. In FIG. 1, the left side of a frame 11 which forms the main body of a printer constitutes itself the front side of the printer. On the bottom part side of this frame 11, a paper feeding portion 12 is built in as inclined downwardly toward the rear part of the frame 11. Recording papers retained in a stack on this paper feeding portion 12 are fed one by one toward the downstream side. For the purpose of regulating the recording papers in the direction of width thereof, the paper feeding portion 12 is provided with a width regulating plate 13. For the purpose of facilitating the setting of recording papers to the paper feeding portion 12, a front surface cover 14 is openably attached to the frame 11.

The frame 11 is provided in the central part thereof with a laser beam scanning optical unit 15. The frame 11 is further provided in the rear end part thereof with a hinge part 16. A lid member 17 is attached to the hinge part 16 swingably thereabout. Inside the frame 11, an image producing cartridge 18 is detachably disposed as positioned on the lower side of the lid member 17.

The recording papers mounted on the paper feeding portion 12 are fed out one by one jointly by a paper feeding roller 21, a cam 22, and a pinch roller 23 held in contact therewith. They are transported as guided by a guide member and then discharged through an opening part 24 formed in the lid member 17 onto the lid member 17 in the direction of the front side of the image producing apparatus.

To the recording paper in process of conveyance, a latent image formed on a photosensitive drum 25 of the image producing unit 18 is transferred by the cooperation of the photosensitive drum 25 and a transfer roller 26. The transferred image is thermally fused on the recording paper by fixing rollers 27 and 28 disposed on the frame 11. For the purpose of enabling the recording paper having the image formed thereon to be discharged via the opening part 24 onto the lid member 17, a pair of paper discharging rollers 29 are attached to the inner side of the lid member 17. The optical unit 15 is provided with a polygon mirror 31 which is to be impinged on by the light from a light source composed of a semiconductor laser and a collimator both omitted from illustration. It is further provided with such a well known member as a turnaround mirror 32.

The photosensitive drum 25 of the image producing cartridge 18 is adapted to be impinged on by the laser beam from the optical unit 15. A developing sleeve 34 is disposed inside the image producing cartridge 18 so as to adjoin the sensitive drum 25. To the developing sleeve 34, the toner stored in a toner tank 35 is supplied via a window part formed in a diaphragm 37 by the rotation of a vane member 36. The residual toner adhering to the sensitive drum 25 is removed by a cleaning blade omitted from illustration herein. For receiving the removed toner, a waste toner tank 38 is formed in the upper part of the interior of the cartridge 18. An electrifying brush 39 is held in contact with the peripheral surface of the sensitive drum 25. The sensitive drum 25 is charged to a prescribed potential by this electrifying brush 39. The image producing cartridge 18 constructed as described above is otherwise called an image cartridge or process cartridge and is replaced with a new supply when the service life of the photosensitive drum 25 expires or the toner is exhausted.

Figure 2:
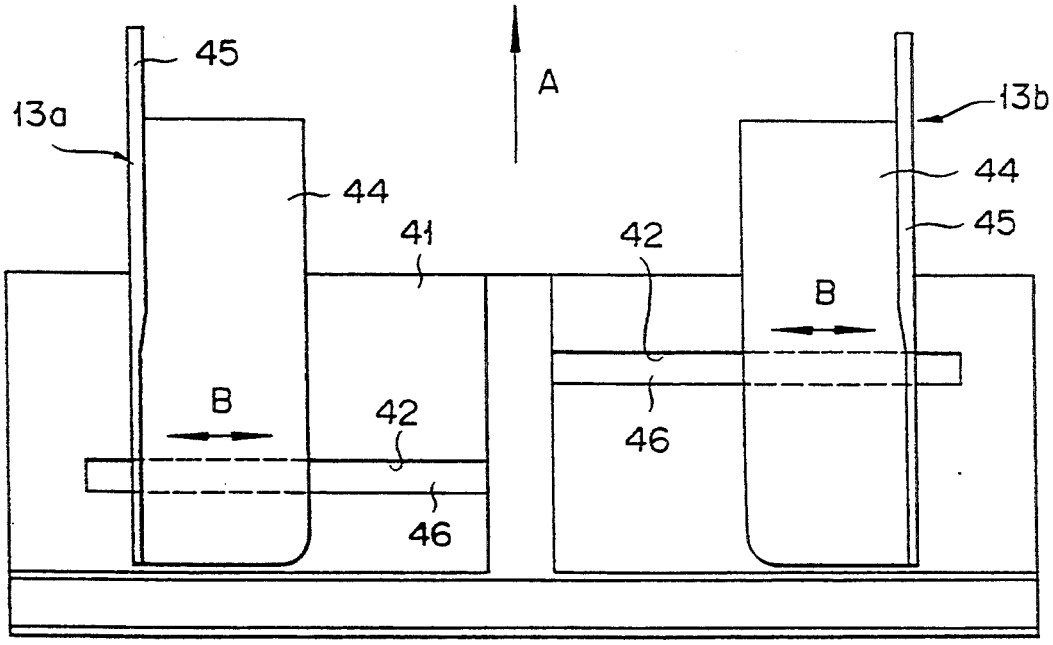
FIG. 2 is a plan view illustrating the paper feeding portion shown in FIG. 1.
Figure 3:
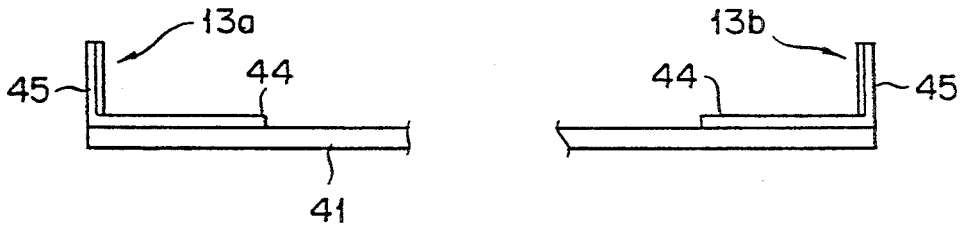
FIG. 3 is a partially omitted front view of the illustration of FIG. 2.

FIG. 2 is a plan view illustrating in detail the paper feeding part 12 shown in FIG. 1. FIG. 3 is a partially omitted front view of the illustration of FIG. 2. The recording papers mounted in a stack on the paper feeding part 12 are transported one by one in the direction of paper feeding indicated by the arrow A. The recording papers in the paper feeding part 12 have the position thereof regulated in the direction of width, namely in the direction indicated by the arrow B, by two width regulating parts **13*a*, 13*b*** which are disposed on the left and right sides of the stack of recording papers.

Figure 4:
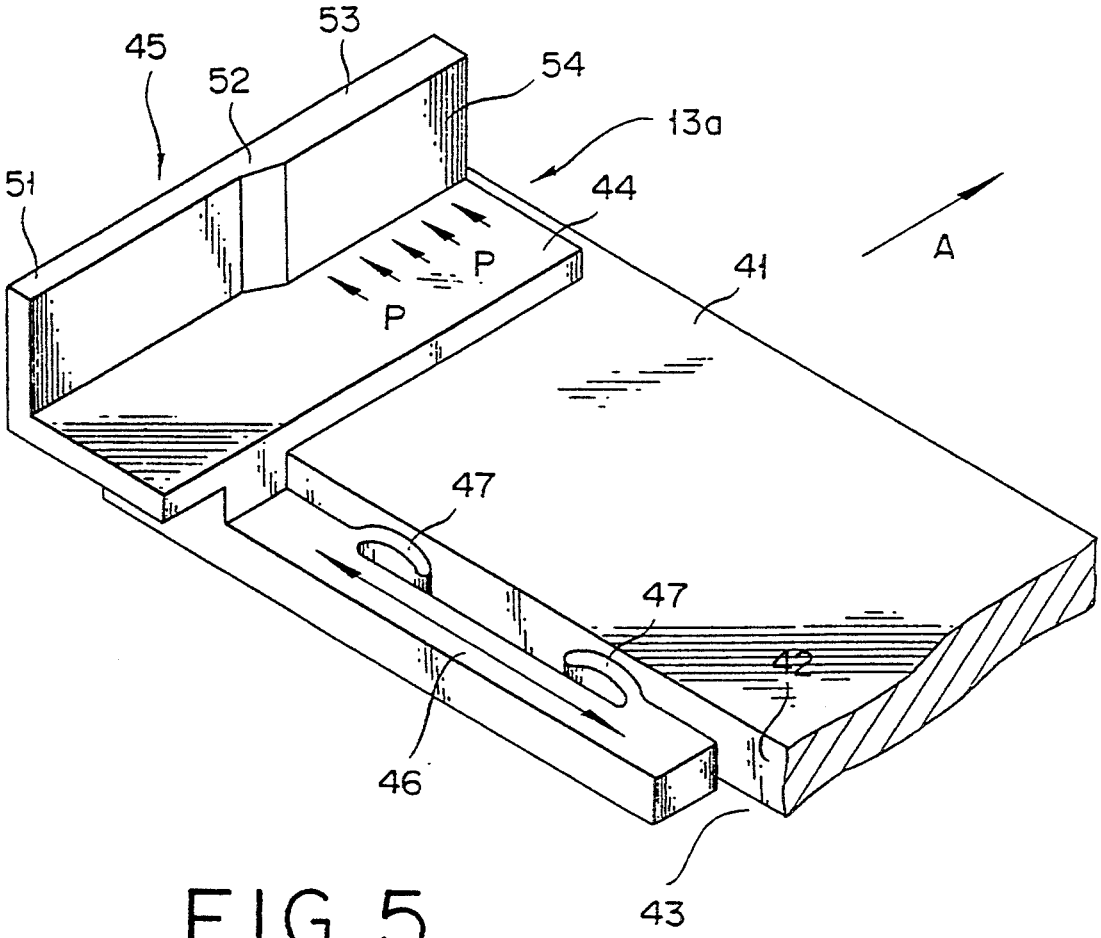
FIG. 4 is a perspective view illustrating one of opposite width regulating members.

This paper feeding part 12 is provided with a supporting member 41 for supporting the recording papers. On this supporting member 41, a guide groove 43 is formed as illustrated in FIG. 4. The guide groove 43 is possessed of a guide surface 42 extending in the direction indicated by the arrow B, i.e. the direction perpendicular to the direction A of conveyance of a recording paper in process of departure from the paper feeding part 12.

The width regulating member **13*a* as one odd of the pair of width regulating members is illustrated in FIG. 4. The width regulating member 13*a* is possessed of a horizontal portion 44 and a vertical portion 45 raised perpendicularly to the horizontal portion 44. The horizontal portion 44 is provided with a slide portion 46. This slide portion 46 is formed of resin. Two brake portions 47 adapted to pressingly contact with the guide surface 42 are integrally formed on the slide portion 46 in a bent state. By virtue of these brake portions 47, a light push given thereto by the operator suffices to impart to the width regulating member 13*a* a braking force enough for the width regulating member 13*a* to produce a sliding motion. Incidentally, it is permissible to form the slide portion 46 alone with resin and the horizontal portion 44 and the vertical portion 45 of the width regulating member 13*a* with metallic material. It is further permissible to form the brake portions 47 each with a metallic spring material and attach these spring materials to the slide portion 46**.

On the vertical portion 45 of the width regulating member **13*a*, the portion on the side opposite to the transporting direction of a recording paper forms a thin portion 51, the middle portion forms a taper portion 52, and the portion on the side in the transporting direction forms a thick portion 53. The thick portion 53, therefore, protrudes inwardly relative to the thin portion 51 and the inner surface of the thick portion 53 constitutes itself the width regulating surface 54 destined to contact the lateral edge of the stack of recording papers. The width regulating surface 54 assumes a position which deviates from the slide portion 46** in the direction A of conveyance of a recording paper.

The other width regulating member **13*b* has substantially the same construction as the width regulating member 13*a*, excepting the position of the slide portion 46 deviates in the direction A of conveyance relative to the slide portion 46 of the width regulating member 13*a***.

Since the thin portion 51 and the taper portion 52 are formed in the portion of the vertical portion 45 of each of the width regulating members **13*a* and 13*b* which corresponds to the slide portion 46 as described above, the operator in the process of placing recording papers in a stack within the paper feeding part 12 is enabled to slide the width regulating member easily and press the width regulating surface 54 of each of the width regulating parts against the lateral edge of the stack of recording papers by taking hold of such portions as the thin portion 51 and the taper portion 52 in his hands and making the width regulating members 13*a* and 13*b*** to slide in the direction of width of the recording papers.

Figure 5:
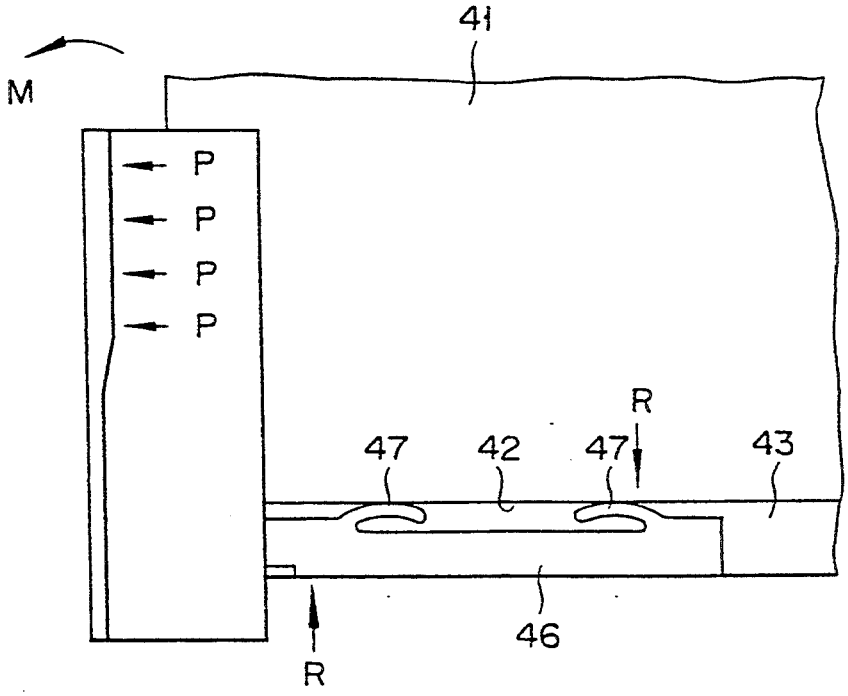
FIG. 5 is a plan view illustrating the state in which the width regulating member is caused by a recording paper to generate moment.

When the recording papers stored in the paper feeding portion 12 are paid out one after another to effect supply of paper and one such recording paper in process of conveyance happens to swerve and press itself against the width regulating surface 54, since the width regulating surface 54 has automatically deviated in the direction A of conveyance relative to the slide portion 46, the pressure P causes the width regulating part 13*a* to generate moment M as illustrated in FIG. 5. As a result, the slide portion 46 generates resistance R at two portions thereof. Even when the brake portions 47 are set applying a small braking force to the supporting member 41, therefore, the possibility that the width regulating members 13*a* and 13*b* will gain in mobile power and will easily slide is precluded.

Figure 6:
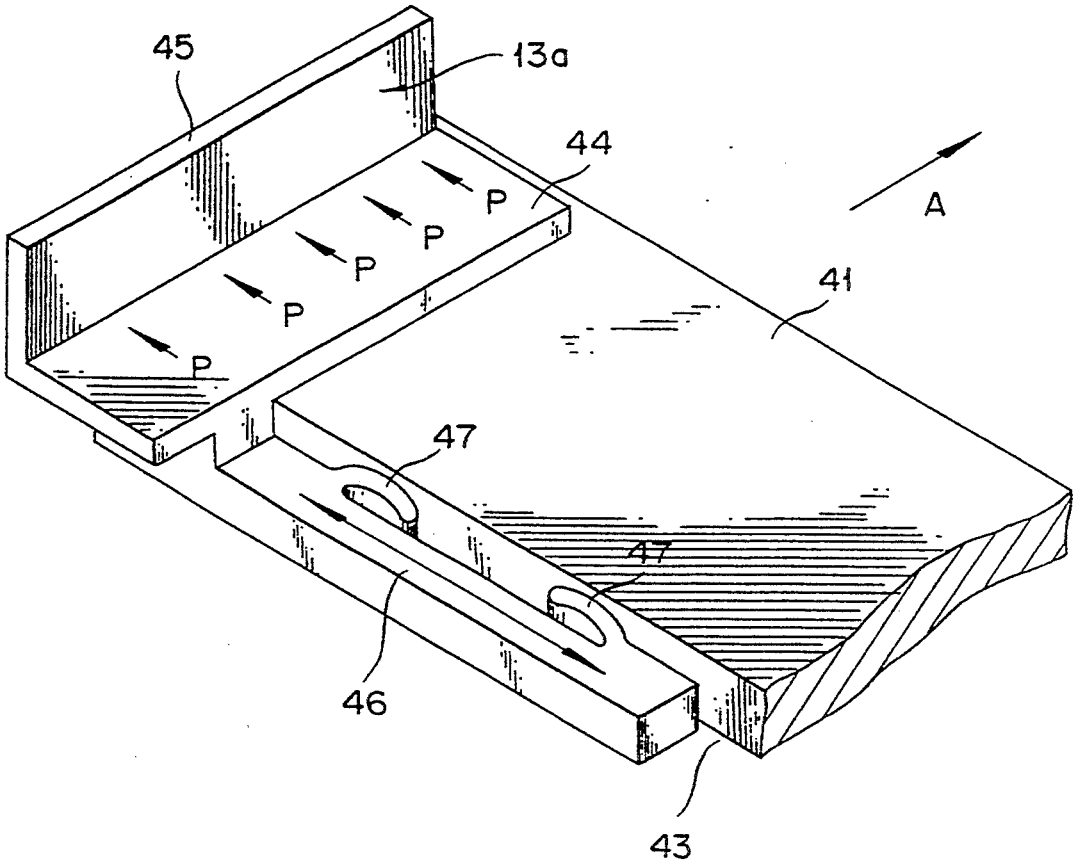
FIG. 6 is a perspective view illustrating a width regulating member as a comparative example.

FIG. 6 is a diagram illustrating a comparative example. The generation of moment such as is described above no longer occurs when the vertical portion 45 of the width regulating member 13*a* is given a uniform wall thickness throughout the entire length thereof and the width regulation surface is formed on the entire inner surface of the vertical portion 45 as illustrated in the diagram. When the braking force produced by the brake portions 47 is decreased in consideration of the operability of the width regulating members 13*a* and 13*b*, the possibility arises that a recording paper in process of conveyance from the paper feeding device will swerve and, owing to the pressure generated by the swerve, the width regulating members 13*a* and 13*b* will be caused to slide. Even when the brake portions 47 are so adapted as to produce a braking force small enough for the width regulating members 13*a* and 13*b* to enjoy ideal operability, however, the possibility of the width regulating members 13*a* and 13*b* being deflected as by a swerve possibly generated in a recording paper in process of conveyance is perfectly precluded by causing the width regulating surface 54 to deflect from the slide portion 46.

While the illustrated embodiment represents a case of having two width regulating members attached to a supporting member in an independently slidable manner, it is permissible to use one of the width regulating members in a stationary manner and the other width regulating member in a freely slidable manner. In contrast to the illustrated apparatus in which the paper feeding part is built in the printer, the apparatus may be so altered that the paper feeding part will be fabricated in the form of a cassette which is capable of being detachably attached to the printer. Further, this invention can be applied to not only the printer but also a copying device.

It is claimed:

1. A paper feeding device comprising:

a pair of regulating members for regulating the position of recording paper in a direction perpendicular to a paper transporting direction, at least one of the regulating members being slidable in the direction perpendicular to the paper transporting direction by a slide member attached thereto and having a regulating surface which contacts a side of the recording paper;

a supporting member for supporting recording paper thereon; and at least one guide provided on the supporting member in the direction perpendicular to the paper transporting direction so that the slide member of said regulating member is slidably connected therewith, the guide being provided at a position displaced from the regulating surface of said regulating member in the paper transporting direction.

2. The paper feeding device as claimed in claim 1, wherein said slide member includes a brake portion contacting said guide for braking said regulating member.

3. The paper feeding device as claimed in claim 1, wherein said slide member is made of resin.

4. The paper feeding device as claimed in claim 1, wherein said at least one of the regulating members includes a horizontal portion along said supporting member and a vertical portion vertically rising from the horizontal portion and including said regulating surface.

5. The paper feeding device as claimed in claim 4, wherein said vertical portion has a thin portion close to said slide member, a thick portion far from said slide member in the paper transporting direction and a taper portion between the thin and thick portions, and said regulating surface is provided at the thick portion.

* * * * *